US006821932B2

(12) United States Patent
Guinther et al.

(10) Patent No.: US 6,821,932 B2
(45) Date of Patent: Nov. 23, 2004

(54) DELIVERING MOLYBDENUM FROM A LUBRICANT SOURCE INTO A FUEL COMBUSTION SYSTEM

(75) Inventors: Gregory H. Guinther, Richmond, VA (US); Vincent J. Gatto, Midlothian, VA (US); Joseph W. Roos, Mechanicsville, VA (US); Scott D. Schwab, Richmond, VA (US)

(73) Assignee: Ethyl Corporation, Richmond, VA (US)

( * ) Notice: Subject to any disclaimer, the term of this patent is extended or adjusted under 35 U.S.C. 154(b) by 9 days.

(21) Appl. No.: 10/321,143

(22) Filed: Dec. 17, 2002

(65) Prior Publication Data

US 2004/0115574 A1 Jun. 17, 2004

(51) Int. Cl.[7] ..... P01N 3/00

(52) U.S. Cl. ..... 508/110; 60/274; 431/4; 123/1 A

(58) Field of Search ..... 431/4; 508/110

(56) References Cited

U.S. PATENT DOCUMENTS

| | | | | |
|---|---|---|---|---|
| 4,155,860 A | | 5/1979 | Soucy | |
| 5,376,154 A | | 12/1994 | Daly et al. | |
| 5,674,822 A | * | 10/1997 | Schlosberg et al. | 508/485 |
| 5,925,600 A | * | 7/1999 | Atherton | 508/364 |
| 6,200,358 B1 | | 3/2001 | Fleischer et al. | |
| 6,268,316 B1 | * | 7/2001 | Tanaka et al. | 508/291 |
| 6,419,477 B1 | * | 7/2002 | Robinson | 431/4 |
| 6,444,624 B1 | * | 9/2002 | Walker et al. | 508/363 |
| 6,528,461 B1 | * | 3/2003 | Mike et al. | 508/287 |
| 6,602,445 B2 | * | 8/2003 | Schofield | 252/389.54 |
| 6,629,407 B2 | * | 10/2003 | Roos et al. | 60/274 |

FOREIGN PATENT DOCUMENTS

| | | |
|---|---|---|
| EP | 1 215 272 A1 | 6/2002 |
| EP | 1 321 506 A2 | 6/2003 |
| EP | 1 338 590 A1 | 8/2003 |
| WO | WO 01/72759 A1 | 10/2001 |
| WO | WO 03/064568 A2 | 8/2003 |

* cited by examiner

*Primary Examiner*—Ellen M. McAvoy
(74) *Attorney, Agent, or Firm*—Leah Oubre Robinson; Dennis H. Rainear

(57) ABSTRACT

The present invention relates to an apparatus and method for delivering molybdenum from a lubricant source into a fuel combustion system or to the exhaust therefrom. By the present invention, molybdenum from the lubricant or the fuel will interact with phosphorus, sulfur, and/or lead from the combustion products. In this manner, the molybdenum scavenges or inactivates harmful materials which have migrated into the fuel or combustion products, and which can otherwise poison catalytic converters, sensors and/or automotive on-board diagnostic devices. The present invention can also lead to improved durability of exhaust after treatment systems.

34 Claims, 2 Drawing Sheets

Figure 1: Metal Efficiency at Diesel Soot Light-Off
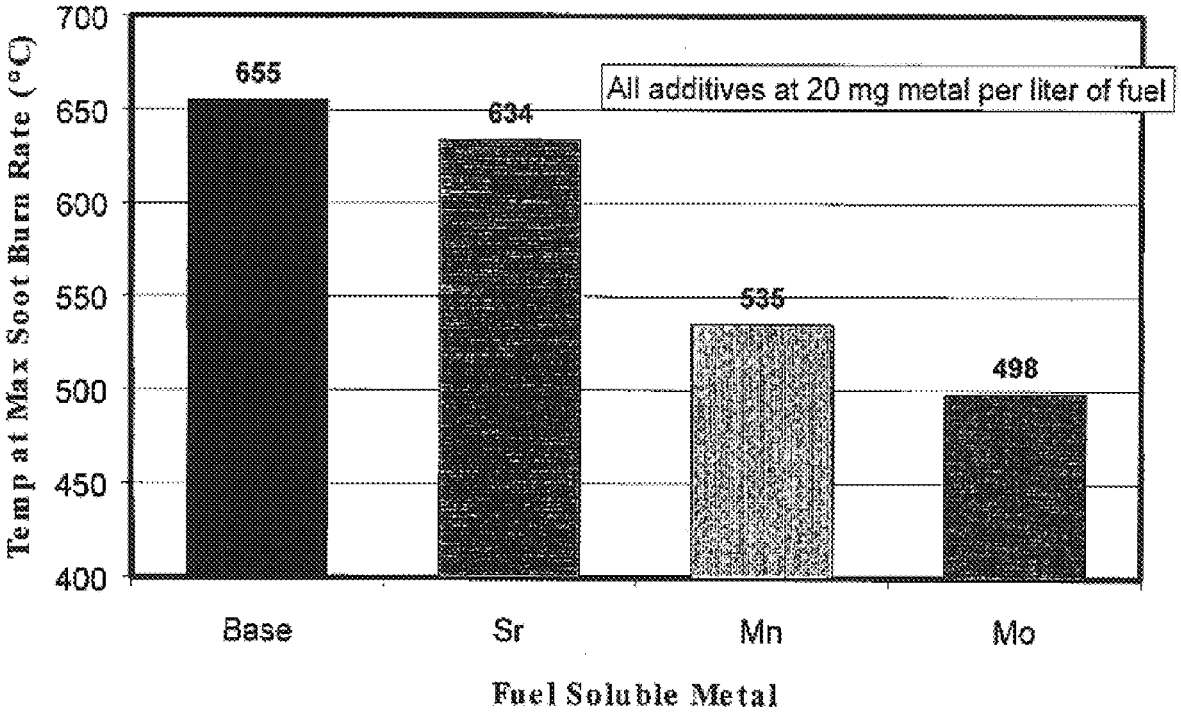

Figure 2: Metal Gravimetric Efficiency in Soot Light-Off
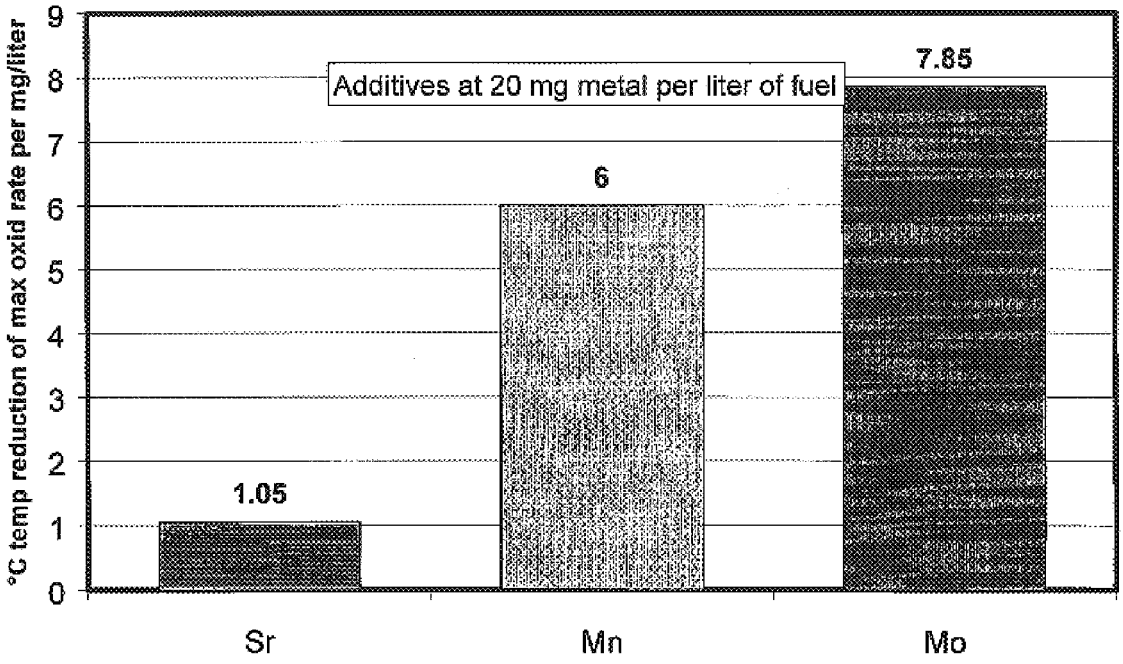

DELIVERING MOLYBDENUM FROM A LUBRICANT SOURCE INTO A FUEL COMBUSTION SYSTEM

FIELD OF THE INVENTION

The present invention relates to an apparatus and method for delivering molybdenum from a lubricant source into a fuel combustion system or to the exhaust therefrom. By the present invention, molybdenum from the lubricant will interact with phosphorus, sulfur, and/or lead from the combustion products. Molybdenum can also enter the combustion system in the present invention as a component of the fuel being burned. In this invention, the molybdenum scavenges or inactivates harmful materials which have migrated into the fuel or combustion products, and which can otherwise poison catalytic converters, sensors and/or automotive on-board diagnostic devices. The invention thus provides a method for improving combustion efficiency of a fuel being combusted in a combustion unit through the introduction therein of molybdenum. The present invention can also lead to improved durability of exhaust after treatment systems.

BACKGROUND OF THE INVENTION

A problem exists in fuel combustion systems in which the fuel contains, or acquires, or produces upon combustion, one or more metal (e.g. lead), sulfur, and/or phosphorus contaminants that can poison or degrade catalytic converters, sensors, or on-board diagnostic devices.

An additional problem is created by such contaminants in the form of undesirably increased levels of certain combustion products or by-products in the exhaust.

Yet another problem from such contaminants is a detrimental effect on after treatment systems. These contaminants can include elemental phosphorus, lead and sulfur, or compounds thereof in the fuel, or in the air. The contaminants can also get into the fuel, or the combustion chamber, or the combustion exhaust stream from the engine lubricants which often contain phosphorus-containing and sulfur-containing additives, and lead compounds associated with combustion system wear. In addition, the combustion in a waste incinerator of waste engine oil will often have oil containing a molybdenum lubricity or antioxidant additive.

It is a well-known phenomenon that vehicles and other combustion systems consume, that is the engine burns, oil used as a lubricant for the engine or moving parts of a combustion system. Various pathways exist for lubricating oil to enter the combustion system, and/or its exhaust stream. Clearly the various components or additives in the lubricating oil also are consumed or burned and these components or additives can have deleterious effects on the combustion system's catalysts, after treatment system, and emissions.

It is therefore desirable to inhibit, reduce or prevent the deleterious interaction of components (such as phosphorus, lead and/or sulfur arising from the lubricant source, air or fuel or otherwise entering the combustion process) with the combustion exhaust stream to thereby prevent catalyst poisoning, after treatment system malfunction, and increased emissions.

SUMMARY OF THE INVENTION

In an embodiment, the present invention provides a method to inhibit, reduce or prevent the deleterious interaction of components (such as phosphorus, lead and/or sulfur arising from the lubricant source, any processing aid or adjuvant, fuel, fuel additive, air or otherwise entering the combustion process) with the combustion exhaust stream of a combustion unit by the introduction to the unit or its exhaust stream of an effective amount of molybdenum to thereby prevent catalyst poisoning, sensor poisoning, after treatment system malfunction, and/or increased emissions.

In another embodiment, the present invention provides a system for adding an effective amount of molybdenum to the combustion of a fuel for scavenging phosphorus, lead and/or sulfur from the fuel or the products resulting from the combustion of the fuel.

The present invention further relates to methods to improve the durability of an after treatment device for a combustion system, wherein the method includes contacting the products of the combustion of a hydrocarbonaceous fuel with a lubricant containing molybdenum in an amount sufficient for the molybdenum to interact with one or more contaminants selected from the group consisting of phosphorus, sulfur, lead or compounds thereof in said products to thereby reduce the amount of one or more of the contaminants contacting the after treatment device.

By "molybdenum" herein is meant any molybdenum compound, source or material, including but not limited to molybdenum trioxide, mono-nuclear and di-nuclear and tri-nuclear molybdenum sulfonate, molybdenum phenate, molybdenum salicylate, molybdenum carboxylates, molybdenum dithiocarbamates, neutral and overbased molybdenum salicylates, neutral and overbased molybdenum phenates, neutral and overbased molybdenum sulfonates, ammonium molybdate, sodium molybdate, potassium molybdate, and molybdenum halides, compounds derived from molybdenum reacted with amines and alcohols, and combinations and mixtures thereof. Examples of commercial sulfur-containing oil soluble molybdenum compounds are Sakura-Lube 100, Sakura-Lube 155, Sakura-Lube 165, and Sakura-Lube 180 from Asahi Denka Kogyo K.K., Molyvan® A, Molyvan® 807 and Molyvan® 822 from R. T. Vanderbilt Company, and Naugalube MolyFM from Crompton Corporation. Examples of commercial sulfur- and phosphorus-free oil soluble molybdenum compounds are Sakura-Lube 700 from Asahi Denka Kogyo K.K., and Molyvan® 856B and Molyvan® 855 from R. T. Vanderbilt Company, Inc.

The molybdenum is preferably present in the lubricant as an oil-soluble additive that can volatilize and thereby enter the combustion chamber or exhaust stream. It may also enter the combustion chamber through "bulk" consumption, i.e., past valve guides or around piston rings.

By "base oil" herein is meant a base oil which can be selected from the group consisting of paraffinic, naphthenic, aromatic, poly-alpha-olefins, synthetic esters, and polyol esters, and mixtures thereof. In a preferred embodiment, the base oil contains less than or equal to 0.03 wt. % sulfur, and greater than or equal to 90 wt. % saturates, and has a viscosity index greater than or equal to 80 and less than or equal to 120. In another embodiment, the base oil contains less than or equal to 0.03 wt. % sulfur, and greater than or equal to 90 wt. % saturates, and has a viscosity index greater than or equal to 120. In a more preferred embodiment, the base oil is substantially sulfur-free.

By "scavenging" herein is meant the contacting, combining with, reacting, incorporating, chemically bonding with or to, physically bonding with or to, adhering to, agglomerating with, affixing, inactivating, rendering inert, consuming, alloying, gathering, cleansing, consuming, or any other way or means whereby a first material makes a second material unavailable or less available.

By "interaction", "interacting" and "interacts"herein is meant scavenging.

By "inactivating" herein is meant scavenging.

By "hydrocarbonaceous fuel" herein is meant hydrocarbonaceous fuels such as but not limited to diesel fuel, jet fuel, alcohols, ethers, kerosene, low sulfur fuels, synthetic fuels, such as Fischer-Tropsch fuels, liquid petroleum gas, fuels derived from coal, genetically engineered biofuels and crops and extracts therefrom, natural gas, propane, butane, unleaded motor and aviation gasolines, and so-called reformulated gasolines which typically contain both hydrocarbons of the gasoline boiling range and fuel-soluble oxygenated blending agents, such as alcohols, ethers and other suitable oxygen-containing organic compounds. Oxygenates suitable for use in the fuels of the present invention include methanol, ethanol, isopropanol, t-butanol, mixed alcohols, methyl tertiary butyl ether, tertiary amyl methyl ether, ethyl tertiary butyl ether and mixed ethers. Oxygenates, when used, will normally be present in the reformulated gasoline fuel in an amount below about 25% by volume, and preferably in an amount that provides an oxygen content in the overall fuel in the range of about 0.5 to about 5 percent by volume. "Hydrocarbonaceous fuel" or "fuel" herein shall also mean waste or used engine or motor oils which may or may not contain molybdenum, gasoline, bunker fuel, coal (dust or slurry), crude oil, refinery "bottoms" and by-products, crude oil extracts, hazardous wastes, yard trimmings and waste, wood chips and saw dust, agricultural waste, fodder, silage, plastics and other organic waste and/or by-products, and mixtures thereof, and emulsions, suspensions, and dispersions thereof in water, alcohol, or other carrier fluids. By "diesel fuel" herein is meant one or more fuels selected from the group consisting of diesel fuel, biodiesel, biodiesel-derived fuel, synthetic diesel and mixtures thereof. It is preferred that the hydrocarbonaceous fuel is substantially sulfur-free, by which is meant a sulfur content not to exceed on average about 30 ppm of the fuel. Since the fuel useful in the present invention may include used or waste oil having a molybdenum friction modifier or lubricity additive, the molybdenum in the scavenging and protection achieved by the present invention can also come from such a fuel instead of, or in addition to, the lubricant.

By "combustion system" and "apparatus" herein is meant, for example and not by limitation herein, any diesel-electric hybrid vehicle, a gasoline-electric hybrid vehicle, a two-stroke engine, any and all burners or combustion units, including for example and without limitation herein, stationary burners, waste incinerators, diesel fuel burners, diesel fuel engines, automotive diesel engines, gasoline fuel burners, gasoline fuel engines, power plant generators, and the like. The hydrocarbonaceous fuel combustion systems that may benefit from the present invention include all combustion units, systems, devices, and/or engines that burn fuels. By "combustion system" herein is also meant any and all internal and external combustion devices, machines, engines, turbine engines, jet engines, boilers, incinerators, evaporative burners, plasma burner systems, plasma arc, stationary burners, and the like which can combust or in which can be combusted a hydrocarbonaceous fuel.

By "contacting" herein is meant the contacting, bringing together, reacting, complexing, coordinating, combining, admixing, mixing, and the like association between two or more materials, whether or not a chemical or physical reaction or change occurs.

By "essentially free of phosphorus and compounds thereof" is meant an amount of elemental phosphorus or a compound thereof which is less than about 10 ppm in the lubricant or resulting exhaust stream. Such low levels of phosphorus are desirable in many current lubricant formulations, and it is anticipated that lower levels of phosphorus in lubricants will be continually sought, perhaps required. A preferred level of phosphorus in the lubricant is an amount between 1 ppm and approximately 1500 ppm. A more preferred level of phosphorus in the lubricant is an amount between 500 ppm and 1200 ppm.

By "after treatment system" or "after treatment device" herein is meant any system or device which contacts the combustion product(s) from a combustion chamber in a manner designed to oxidize, reduce or otherwise treat the combustion product(s). Examples, but not by way of limitations herein, of such after treatment systems include an automobile three-way catalytic converter, lean $NO_x$ traps, catalyzed diesel particulate filter ("C-DPF") and a continuously regenerating technology diesel particulate filter. "After treatment system" also includes associated sensors like $O_2$ sensors and $NO_x$, sensors. Analogous gasoline combustion after treatment systems are known and are included herein as deriving benefit from the present invention.

It is to be understood that both the foregoing general description and the following detailed description are exemplary and explanatory only and are intended to provide further explanation of the present invention, as claimed.

BRIEF DESCRIPTION OF THE DRAWINGS

FIG. 1 illustrates thermal gravimetric analysis (TGA) results in accordance with some embodiments of the present disclosure.

FIG. 2 illustrates TGA results in accordance with some.

DETAILED DESCRIPTION OF THE PRESENT INVENTION

In a more specific embodiment, the present invention provides a method for reducing the amount of, or the deleterious effect on exhaust emissions after treatment and control devices from, at least one contaminant selected from the group consisting of phosphorus, lead, sulfur, and compounds thereof in an exhaust stream from the combustion of a hydrocarbonaceous fuel in a combustion system lubricated by a lubricant, said method including the steps: (a) lubricating the combustion system with the lubricant comprising a major amount of a base oil of lubricating viscosity and a minor amount of one or more additives comprising (i) at least one organosulfur compound, or at least one organophosphorus compound, or both, and (ii) at least one molybdenum source; (b) combusting in the combustion system the hydrocarbonaceous fuel to produce combustion products comprising at least one contaminant material selected from the group consisting of sulfur, lead, phosphorus, and compounds thereof; and (c) contacting the molybdenum with the sulfur, lead, phosphorus, and compounds thereof in the combustion products, whereby the molybdenum interacts with the sulfur, lead, phosphorus, and/or compounds thereof. This interaction between the molybdenum and the sulfur, lead, phosphorus, and/or compounds thereof results in the scavenging of the contaminants, whereby several beneficial results are obtained. By scavenging at least one and preferably more or all of the contaminants, the beneficial results include maintaining catalytic converter performance, maintaining sensor performance, maintaining LNT performance, and maintaining diesel particulate filter (DPF) performance.

The present invention also provides a method of improving the combustion of a fuel in a combustion system for improving DPF performance, as determined by reduced thermal gravimetric analysis soot light-off temperature, said method comprising introducing a combustion improving amount of molybdenum to the combustion in a combustion system of a fuel, whereby the thermal gravimetric analysis light-off temperature is reduced relative to the thermal gravimetric analysis light-off temperature achieved in the absence of the introduction of molybdenum.

When cars are operated with molybdenum in the lubricant, less phosphorus, sulfur, and lead will be deposited on the car's catalytic converter. According to the present invention, less phosphorus, sulfur and lead is deposited throughout the catalyst when Mo has been combusted in or with the fuel. Molybdenum is combining in the combustion or exhaust stream with phosphorus and/or sulfur to form stable molybdenum-phosphorus and/or molybdenum sulfate species that do not form impermeable or reduced-permeability glazes on the catalyst. With less impermeable glaze on the catalyst, less emissions can "break through", i.e., pass through as unconverted emissions. Therefore, it is desirable to have Mo in the combustion and/or exhaust stream.

Thus, the present invention provides a method to inhibit the formation of a phosphorus-containing, sulfur-containing, or lead-containing permeability-reducing glaze on the surface of a catalyst exposed to the products from the combustion in a combustion unit of a fuel, wherein the method includes contacting molybdenum with the products of combustion of the fuel, wherein the products contain at least one member selected from the group consisting of phosphorus-containing, sulfur-containing and lead-containing materials. The sulfur-containing materials can poison the active metals of the catalyst whether or not a sulfur-containing glaze is formed on the surface of the catalyst.

Further evidence of phosphorus, sulfur and lead protection and lower emissions achieved by the presence of molybdenum in the combustion product of a lubricant or fuel containing molybdenum can be drawn from the literature that teaches that molybdenum can be used to protect platinum catalysts from sulfur poisoning in refinery naphtha reforming reactions, and also in hydrodesulfurization reactions for lowering sulfur in gasoline and diesel fuels. (B. Delmon, "Recent Approaches to the Anatomy and Physiology of Cobalt Molybdenum Hydrodesulfurization Catalysts," Proceedings of the Climax Third International Conference on the Chemistry and Uses of Molybdenum, Ann Arbor, Mich., Aug. 19–23, 1979, p. 73–84.

As an additional benefit, molybdenum in the exhaust after treatment system can be expected to scavenge lead to form the white colored, well-known normal molybdate "$PbMoO_4$" (melting point 1065° C.), also known as wulfenite (Cotton, F. A., and Wilkinson, G.; "Advanced Inorganic Chemistry, Fifth Edition, John Wiley & Sons. New York, p. 805). and prevent lead poisoning of the exhaust emissions after treatment equipment.

The most important ore of molybdenum is molybdenite ($MOS_2$). By virtue of the "natural stability"of $MoS_2$, this material would be the most likely species forming as a result of the molybdenum-sulfur interaction spelled out in this invention. Molybdenum oxides, when heated in the presence of a sulfur source, give $MoS_2$, which is the most stable molybdenum sulfide at high temperature. According to Cotton, this sulfide has a crystal lattice of close-packed layers of sulfur atoms creating trigonal prismatic interstices occupied by molybdenum atoms. Therefore, by scavenging sulfur, the resulting product, $MoS_2$, is protecting the exhaust after treatment system from catalyst poisons.

The present invention thus establishes that the molybdenum in the combustion stream scavenges catalyst pollutants by tying them up as sulfides, phosphates, and lead molybdates. These product compounds then participate further in emissions control as demonstrated in the following example.

Example: Thermal gravimetric analysis (TGA) testing was used to determine the effect of the fuel soluble metal additives on the temperature of maximum soot oxidation. Particulate matter (PM) generated from a 1998 Cummins M-11 engine operated on the US EPA transient emissions cycle was collected on a quartz fiber filter. The oil used was a heavy duty diesel oil with ZDDP in the additive package. Elemental analysis of the oil gave the following results in parts per million (ppm): Phosphorus (1264), sulfur (4000), zinc (1437), boron (407), calcium (3614), and magnesium (18). The base fuel used was a number 2 diesel fuel with 388 ppm by weight sulfur. From this fuel, three additional fuels were made by adding strontium, manganese, and molybdenum at 20 mg metal per liter fuel, respectively. For each separate fuel, PM generated during three consecutive EPA Heavy-Duty Transient cycles was collected on a single filter using a Pierburg PS2000A particulate sampling system. TGA was then performed on small sections of each PM loaded filter using a TA Instruments Model 2950. The sample temperature was increased at a rate of 20° C./minute under air at ambient pressure for all runs. From a plot of weight loss vs. time, the temperature at which the maximum soot oxidation rate occurred was determined. The TGA results of the four sets of particulates are plotted in FIGS. 1 & 2. FIG. 1 shows the metal additives in mg metal per liter of fuel while FIG. 2 show the same results calculated in gravimetric efficiency of the respective metals. Both Figures show that after scavenging the sulfur and phosphorus coming from the fuel and oil used, the molybdenum also lowered the light off temperature by 157° C. from that of the base fuel (655° C.) to that of the molybdenum containing system (498° C.). These results show that after scavenging sulfur, phosphorus, and lead from the combustion/exhaust system, the resultant molybdenum products are also active in carbon burnout chemistry and result in a further soot lowering as shown in FIGS. 1 and 2. If the emissions control system contains a catalyst of any nature, for example, a continuously regenerating diesel particulate filter (DPF), or a diesel oxidation catalyst, and/or a lean $NO_x$, trap (LNT), then these emission control units would also be protected from the sulfur, phosphorus, and lead poisoning and therefore retain their performance level so long as the molybdenum scavenger is in the system. This significant molybdenum synergism with the system catalysts in soot oxidation is an unexpected bonus to the scavenging benefit of the molybdenum that would be added to the lubricant.

It should be understood that the contaminants being scavenged according to the present invention by the molybdenum from the lubricant can originate from the air utilized in the combustion of the hydrocarbonaceous fuel.

In another embodiment, the contaminants being scavenged according to the present invention by the molybdenum can originate from the hydrocarbonaceous fuel.

In yet another embodiment of the present invention, the contaminants being scavenged by the molybdenum can originate from the lubricant used to lubricate the combustion system.

In one embodiment, the lubricant-borne molybdenum which will scavenge the contaminant(s) can bleed, "blowby", flow, seep, be forced or compressed, be drawn, sucked, or aspirated or otherwise accidentally or deliberately get into a combustion chamber of the combustion system. In this embodiment, the contaminant(s) encounter and interact with the molybdenum during or after the combustion process, whereby scavenging occurs. Thus an embodiment of a method of the present invention is achieved when lubricant containing molybdenum escapes around a valve in the combustion system, such as for example and not as a limitation herein, an intake valve or an exhaust valve in an automotive engine. In this manner, the molybdenum is caused to encounter and interact with the contaminant(s), whereby scavenging can occur.

In another embodiment, the molybdenum is caused, deliberately or inadvertently, to encounter the contaminant(s) in a passageway through which the combustion products containing the contaminant(s) are conveyed away from the combustion chamber. In this manner, the scavenging occurs outside the combustion chamber of the combustion system.

In another embodiment of the present invention, the molybdenum volatilizes from the lubricant and is carried over into the combustion chamber containing the fuel.

In yet another embodiment, the combustion system utilizes a deliberate recirculating process, whereby vapors in a crankcase are recirculated into either the intake manifold or the combustion chamber. In this manner, any lubricant containing the phosphorus, sulfur, and/or lead contaminants is caused to encounter and interact with molybdenum in the combustion or exhaust.

In one embodiment, the fuel or the exhaust from its combustion is treated with a low level of molybdenum, such as for example, a molybdenum level of about 20 ppm Mo in the fuel or combustion exhaust or less.

This invention also achieved catalyst protection and contaminant scavenging when the fuel combusted contains an oil having a molybdenum compound, without extra molybdenum being delivered to the combustion unit or its exhaust from a lubricant source.

The present invention provides in another embodiment an apparatus for performing a method for reducing the amount of, or deleterious effect on exhaust emissions after treatment and control devices of, at least one contaminant selected from the group consisting of phosphorus, lead, sulfur and compounds thereof in an exhaust stream, wherein the apparatus contains (a) a combustion chamber adapted to combust a hydrocarbonaceous fuel; (b) a means to introduce the hydrocarbonaceous fuel into the combustion chamber; (c) a means to convey combustion product from the combustion chamber; (d) a lubricant comprising a major amount of a base oil of lubricating viscosity and a minor amount of one or more additives comprising (i) at least one organosulfur compound, or at least one organophosphorus compound, or both, and (ii) at least one molybdenum source; and (e) a means to introduce the lubricant to the combustion product. The apparatus can further contain an after treatment device or system.

According to one embodiment of the present invention, the organosulfur compound in the lubricant can be selected from the group consisting of sulfurized olefins, sulfurized fats and vegetable oils, sulfurized unsaturated esters and amides, ashless and metal containing dithiocarbamates, substituted thiadiazoles, sulfurized hindered phenols, sulfurized alkylphenols, neutral metal-containing sulfonate detergents, overbased metal-containing sulfonate detergents, neutral metal-containing sulfurized phenate detergents, and overbased metal-containing sulfurized phenate detergents, or combinations and mixtures thereof.

According to another embodiment, the organophosphorus compound in the lubricant can be selected from the group consisting of primary, secondary and aryl neutral and overbased zinc dialkyldithiophosphates (ZDDP's), trialkyl- and triarylphosphites, mixed alkyl/aryl phosphites, alkyl and aryl phosphorothiolthionates, and alkyl and aryl phosphorothionates, and combinations or mixtures thereof.

It is therefore believed that by the use of the present invention a significant reduction in the amount of phosphorus detected on a device such as a catalyst can be achieved when molybdenum is in the exhaust stream from a combustion system. Specifically, reductions in the amount of such contaminants above 20% by weight, and more preferably reductions in an amount of from 60% to 80% by weight detected on the after treatment device will be achieved by the present invention. This will produces a dramatic and highly desirable benefit in the improved durability of such after treatment devices or systems.

Other embodiments of the present invention will be apparent to those skilled in the art from consideration of the specification, Figures and practice of the invention disclosed herein. It is intended that the specification and Figures be considered as exemplary only, with a true scope and spirit of the invention being indicated by the following claims.

What is claimed is:

1. A method for reducing the deleterious effect on exhaust emissions after treatment and control devices of at least one contaminant selected from the group consisting of phosphorus, lead, sulfur and compounds thereof in an exhaust stream from the combustion of a hydrocarbonaceous fuel in a combustion system lubricated by a lubricant, said method comprising the steps:

(a) lubricating the combustion system with the lubricant comprising a major amount of a base oil of lubricating viscosity and a minor amount of one or more additives comprising (i) at least one organosulfur compound, or at least one organophosphorus compound, or both, and (ii) at least one molybdenum source;

(b) combusting in the combustion system the hydrocarbonaceous fuel to produce combustion products comprising at least one material selected from the group consisting of sulfur, lead, phosphorus, and compounds thereof;

(c) contacting the molybdenum with at least one of the sulfur, lead, phosphorus, and compounds thereof in the combustion products, whereby the molybdenum interacts with at least one of the sulfur, lead, phosphorus, and compounds thereof.

2. The method of claim 1, wherein the sulfur, lead, phosphorus, and compounds thereof in the combustion products originate from the fuel.

3. The method of claim 1, wherein the sulfur, lead, phosphorus, and compounds thereof in the combustion products originate from air used in the combustion of the fuel.

4. The method of claim 1, wherein the sulfur, lead, phosphorus, and compounds thereof in the combustion products originate from the lubricant.

5. The method of claim 1, wherein the exhaust stream is essentially free of phosphorus and compounds thereof.

6. The method of claim 1, wherein the combustion system further comprises an after treatment system.

7. The method of claim 6, wherein the after treatment system is selected from the group consisting of a catalyzed diesel particulate filter and a continuously regenerating technology diesel particulate filter.

8. The method of claim 1, wherein the combustion system is selected from the group consisting of any diesel-electric hybrid vehicle, gasoline-electric hybrid vehicle, a two-stroke engine, any and all burners or combustion units, stationary burners, waste incinerators, diesel fuel burners, diesel fuel engines, automotive diesel engines, gasoline fuel burners, gasoline fuel engines, power plant generators, any and all internal and external combustion devices, machines, engines, turbine engines, jet engines, boilers, incinerators, evaporative burners, plasma burner systems, plasma arc, stationary burners, and devices that can combust or in which can be combusted a hydrocarbonaceous fuel.

9. The method of claim 1, wherein the hydrocarbonaceous fuel is selected from the group consisting of diesel fuel, biodiesel, biodiesel-derived fuel, synthetic diesel, jet fuel, alcohols, ethers, kerosene, low sulfur fuels, synthetic fuels, Fischer-Tropsch fuels, liquid petroleum gas, fuels derived from coal, genetically engineered biofuels and crops and extracts therefrom, natural gas, propane, butane, unleaded motor and aviation gasolines, reformulated gasolines which contain both hydrocarbons of the gasoline boiling range and fuel-soluble oxygenated blending agents, gasoline, bunker fuel, coal (dust or slurry), crude oil, used engine or motor oils which may or may not contain molybdenum, refinery "bottoms" and by-products, crude oil extracts, hazardous wastes, yard trimmings and waste, wood chips and saw dust, agricultural waste, fodder, silage, plastics, organic waste, and mixtures thereof, and emulsions, suspensions, and dispersions thereof in water, alcohol, and other carrier fluids.

10. An apparatus for performing the method of claim 1, said apparatus comprising (a) a combustion chamber adapted to combust a hydrocarbonaceous fuel;

(b) a means to introduce the hydrocarbonaceous fuel into the combustion chamber;

(c) a means to convey combustion product from the combustion chamber;

(d) a lubricant comprising a major amount of a base oil of lubricating viscosity and a minor amount of one or more additives comprising (i) at least one organosulfur compound, or at least one organophosphorus compound, or both, and (ii) at least one molybdenum source; and (e) a means to introduce the lubricant to the combustion product.

11. The apparatus of claim 10, further comprising (f) an after treatment system.

12. The apparatus of claim 11, wherein the after treatment system is selected from the group consisting of a catalyzed diesel particulate filter and a continuously regenerating technology diesel particulate filter.

13. The apparatus of claim 10, wherein the apparatus is selected from the group consisting of any diesel-electric hybrid vehicle, gasoline-electric hybrid vehicle, a two-stroke engine, any and all burners or combustion units, stationary burners, waste incinerators, diesel fuel burners, diesel fuel engines, automotive diesel engines, gasoline fuel burners, gasoline fuel engines, power plant generators, any and all internal and external combustion devices, machines, engines, turbine engines, jet engines, boilers, incinerators, evaporative burners, plasma burner systems, plasma arc, stationary burners, and devices that can combust or in which can be combusted a hydrocarbonaceous fuel.

14. A method for improving the durability of an after treatment device for a combustion system, said method comprising contacting the products of the combustion of a hydrocarbonaceous fuel from a combustion system with a molybdenum source in an amount sufficient for the molybdenum to interact with one or more contaminants selected from the group consisting of phosphorus, sulfur, lead or compounds thereof in said products to thereby reduce the amount of one or more of the contaminants contacting the after treatment device.

15. The method of claim 14, wherein the amount of phosphorus detected on the after treatment device is reduced by an amount of from 20% to 80% by weight, relative to the amount of phosphorus detected if molybdenum is not contacted with said products.

16. The method of claim 14, wherein the amount of sulfur detected on the after treatment device is reduced by an amount of from 20% to 80% by weight, relative to the amount of sulfur detected if molybdenum is not contacted with said products.

17. The method of claim 14, wherein the amount of lead detected on the after treatment device is reduced by an amount of from 20% to 80% by weight, relative to the amount of lead detected if molybdenum is not contacted with said products.

18. The method of claim 1, wherein the organosulfur compound in the lubricant is selected from the group consisting of sulfurized olefins, sulfurized fats and vegetable oils, sulfurized unsaturated esters and amides, ashless and metal containing dithiocarbamates, substituted thiadiazoles, sulfurized hindered phenols, sulfurized alkylphenols, neutral metal-containing sulfonate detergents, overbased metal-containing sulfonate detergents, neutral metal-containing sulfurized phenate detergents, and overbased metal-containing sulfurized phenate detergents, or combinations and mixtures thereof.

19. The method of claim 1, wherein the organophosphorus compound in the lubricant is selected from the group consisting of primary, secondary and aryl neutral and overbased zinc dialkyldithiophosphates (ZDDP's), trialkyl- and triarylphosphites, mixed alkyl/aryl phosphites, alkyl and aryl phosphorothiolthionates, and alkyl and aryl phosphorothionates, and combinations or mixtures thereof.

20. The method of claim 1, wherein the molybdenum source in the lubricant is selected from the group consisting of molybdenum trioxide, molybdenum sulfonates, molybdenum phenates, molybdenum salicylates, molybdenum carboxylates, mono-nuclear and di-nuclear and tri-nuclear molybdenum dithiocarbamates, neutral and overbased molybdenum salicylates, overbased molybdenum phenates, overbased molybdenum sulfonates, ammonium molybdate, sodium molybdate and potassium molybdate, and molybdenum halides, compounds derived from molybdenum reacted with amines and alcohols, and combinations and mixtures thereof.

21. The method of claim 1, wherein the base oil is selected from the group consisting of paraffinic, naphthenic, aromatic, poly-alpha-olefins, synthetic esters, and polyol esters, and mixtures thereof.

22. The method of claim 1, wherein the base oil contains less than or equal to 0.03 wt. % sulfur, and greater than or equal to 90 wt. % saturates, and has a viscosity index greater than or equal to 80 and less than or equal to 120.

23. The method of claim 1, wherein the base oil contains less than or equal to 0.03 wt. % sulfur, and greater than or equal to 90 wt. % saturates, and has a viscosity index greater than or equal to 120.

24. The method of claim 1, wherein the base oil is substantially sulfur-free.

25. The method of claim 1, wherein the hydrocarbonaceous fuel contains low levels of sulfur.

26. The method of claim 1, wherein the hydrocarbonaceous fuel is substantially free of sulfur.

27. The method of claim 1, wherein the hydrocarbonaceous fuel contains low levels of sulfur and is further treated with oxygenates.

28. The method of claim 1, wherein the hydrocarbonaceous fuel is substantially free of sulfur and is further treated with oxygenates.

29. The method of claim 1, wherein the hydrocarbonaceous fuel contains low levels of sulfur and is further treated with low levels of molybdenum.

30. The method of claim 1, wherein the hydrocarbonaceous fuel is substantially free of sulfur and is further treated with low levels of molybdenum.

31. A method of improving the combustion of a fuel in a combustion system, as determined by reduced thermal gravimetric analysis light-off temperature of combustion particulate products, said method comprising introducing a combustion improving amount of molybdenum to the combustion in a combustion system of a fuel, whereby the thermal gravimetric analysis light-off temperature is reduced relative to the thermal gravimetric analysis light-off temperature achieved in the absence of the introduction of molybdenum.

32. A method to inhibit the formation of a phosphorus-containing, sulfur-containing, or lead-containing permeability-reducing glaze on the surface of a catalyst exposed to the products from the combustion in a combustion unit of a fuel, said method comprising contacting molybdenum with the products of combustion of the fuel, wherein said products contain at least one member selected from the group consisting of phosphorus-containing, sulfur-containing and lead-containing materials.

33. A method for reducing the deleterious effect on exhaust emissions after treatment and control devices of at least one contaminant selected from the group consisting of phosphorus, lead, sulfur and compounds thereof in an exhaust stream from the combustion of a hydrocarbonaceous fuel containing a molybdenum compound in a combustion system, said method comprising the steps combusting in the combustion system the hydrocarbonaceous fuel containing a molybdenum compound to produce combustion products comprising at least one material selected from the group consisting of sulfur, lead, phosphorus, and compounds thereof, whereby the molybdenum interacts with at least one of the contaminants selected from the group consisting of sulfur, lead, phosphorus, and compounds thereof.

34. The method of claim 6, wherein the after treatment system is selected from the group consisting of lean $NO_x$, trap, and diesel oxidation catalyst.

* * * * *